United States Patent [19]

Schwaab

[11] 4,423,691

[45] Jan. 3, 1984

[54] MATERIAL SENSING MEANS FOR SEWING MACHINES

[75] Inventor: Konstantin Schwaab, Aichwald, Fed. Rep. of Germany

[73] Assignee: Union Special GmbH, Stuttgart, Fed. Rep. of Germany

[21] Appl. No.: 438,064

[22] Filed: Nov. 1, 1982

[30] Foreign Application Priority Data

Nov. 6, 1981 [DE] Fed. Rep. of Germany ..... 3144127

[51] Int. Cl.[3] ..... D05B 69/00

[52] U.S. Cl. ..... 112/272; 112/235

[58] Field of Search ..... 112/272, 121.11, 235, 112/121.12, 220, 221

[56] References Cited

U.S. PATENT DOCUMENTS 4,342,273 8/1982 Petzold ..... 112/272

*Primary Examiner*—Peter P. Nerbun

*Attorney, Agent, or Firm*—John W. Harbst; John A. Schaerli

[57] ABSTRACT

A device for monitoring the passage of workpiece ends through a sewing machine. The device includes a photosensitive receiver connected to one end of a fiber optic cable. The other end of the cable being arranged opposite a reflecting surface and carried by the sewing machine presser foot in a manner preventing the exposed end face thereof from being defiled.

4 Claims, 3 Drawing Figures

MATERIAL SENSING MEANS FOR SEWING MACHINES

FIELD OF THE INVENTION

The invention relates to an apparatus for monitoring or detecting a passage of workpiece through a sewing machine.

BACKGROUND OF THE INVENTION

There are many applications which require the generation of a signal when a workpiece arrives at a predetermined location. Sensor arrangements for scanning flat, sheet like material workpieces as they progress through a sewing machine are known in many variations.

Some machines employ mechanical means for detecting the workpiece edge. Mechanical sensor arrangements, however, have been known to be particularly sensitive and are susceptible to malfunction. Also, mechanical sensors are subject to wear as well as vibration. Some mechanical sensors are too insensitive to detect the movement of a single ply workpiece and, thus, do not provide the reliability required in some operations.

Some devices employ air sensors for detecting the workpiece. These sensors also have drawbacks. The environment in which these sensors find utility is ladden with dust and lint. Many of the machines are also exposed to lubricant, which, when combined with dust and lint in the area, easily clog the air sensor arrangements and thus effect the reliability of same.

In contrast to mechanical sensors, it has been known to use optical scanners or sensors for detecting the workpiece. Such optical sensors, however, also have drawbacks associated therewith. Optical sensors are usually sensitive to light dispersion and differing material density. Further, many optical sensors are sensitive to ambient light. As mentioned above, the environment in which this type of apparatus finds utility is usually ladden with dust and lint, both of which may effect the efficiency of such sensors. Photo cells are usually not employed in the immediate area of sewing because of the vibratory surroundings which prohibit their use. Furthermore, disturbances with light sensors may arise if the operator inadvertently interrupts the light beam, thus producing incorrect detecting signals.

The device disclosed in U.S. Pat. No. 4,342,273 granted to W. A. Petzold was yet another attempted solution to the provision of a suitable workpiece sensor arrangement. Indeed, this patented device did present a solution to the problem of presenting a dense light against a reflecting surface with minimum dispersion and recordation of the reflective results. With this patented device, the delicate end face of an fiber optic cable arranged opposite the reflective surface was protected by a transparent insert. Even this latest advancement has proven to have drawbacks which are disadvantageous in practice. With this patented apparatus, the advancement and abrasive sliding motion of the workpiece pass the transparent insert results in a permanent scratching or marring of the exposed face of the insert eventually resulting in false controls. Moreover, the vibrations of the feed dogs against the insert, which are transferred or transmitted to the end of the fiber cable, are disadvantageous. Thus, this recently patented apparatus, although advantageous and effective in solving many problems was not a complete answer.

SUMMARY OF THE INVENTION

Hence, readily recognizable is the fact that this particular field of technology is still in need of an apparatus for monitoring the progressive advancement of a workpiece and which is not associated with the aforementioned drawbacks and limitations of the other proposals. In view of the above, and in accordance with the present invention, there is provided a Material Sensing Means which effectively and efficiently overcomes the aforementioned drawbacks. The sensing means of the present invention includes a fiber optic means that is capable of transmitting dense light from a removed source to the sewing area of the machine with minimal or no dispersion. One end of the optic cable is arranged opposite a reflecting surface. The problem with the other devices has been avoided by arranging the exposed end face of the optic cable such that it is vertically removed from the path of workpiece advancement. Removal of the end face of the cable from the path of workpiece advancement, although contributing to the answer, is not the complete solution. Additionally, the end face must be and, with the present invention, is arranged in a manner preventing the exposed cable end face from becoming defiled or befouled.

Photo electric means are connected to the other end of the fiber optic light guide at a position removed from the sewing area. The photo electric means being capable of generating a pulse or signal when the workpiece interrupts the light path between the fiber optic means and the reflective surface. This output signal of the photo electric means may be used for any of a variety of purposes, i.e. actuation of a thread cutter, actuation of a tape trimming apparatus, etc.

The advantages of the present invention over the known sensor arrangements is that the end face of the optic cable is buffered from the vibratory surroundings in which it is exposed. Moreover, because the end face of the optic cable is exposed yet removed from the path of workpiece advancement, the possibility of marring or defiling of the end face of the optic cable is minimized. Whereas, the end face of the cable in the disclosed embodiment is arranged such that the advancing workpiece offers a cleansing effect to the exposed end face thus assuring proper and effective operation of the signaling apparatus.

With the above in mind, a primary object of this invention is the provision of a novel sensor arrangement of the type in question which provides a simple yet efficient apparatus for monitoring the progressive movement or advancement of a workpiece through the machine.

Another object of this invention is the provision of a novel arrangement of a signal generating system of the type described wherein the normally disturbing vibratory environment in which the detector finds utility is minimized.

BRIEF DESCRIPTION OF THE DRAWINGS

Having in mind these and other attendent advantages that would be evident from an understanding of this disclosure, the invention comprises the devices, combinations and arrangements of parts as illustrated in the presently preferred embodiment of the invention which is hereinafter set forth in detail to enable those skilled in the art to readily understand the function, operation, construction and advantages of it when read in conjunction with the accompanying drawings in which.

DETAILED DESCRIPTION OF THE PREFERRED EMBODIMENT

Figure 1:
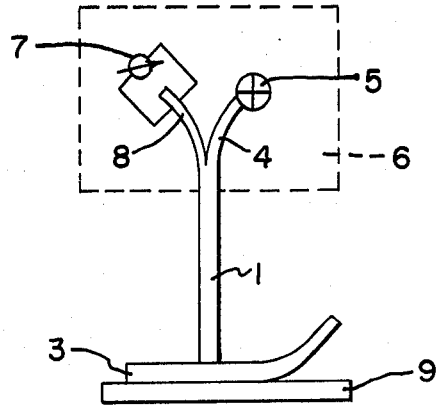
FIG. 1 is a schematic side elevational view of the present invention.

Referring more specifically now to the drawings, the present invention is illustrated for use with a sewing machine. For simplicity and inasmuch to the elements common to most sewing machines, including endwise reciprocal stitch forming instrumentalities and work feeding mechanism means, are well known and form no part of the present invention, a detailed description and illustration thereof is deemed unnecessary.

Turning now to the details of the present invention, there is shown a sensor means 1 in the form of an extended, flexible fiber optic light guide. One end 2 of the light guide or cable 1 is disposed in the direction of workpiece advancement. Preferably end 2 is fixedly accommodated within an aperture provided in the elongated sole plate 3 of the sewing machine presser foot assembly. It should be appreciated, however, that the fiber optic cable end may be otherwise arranged and have the same effect when combined with the further teachings of the invention to be subsequently described. The other end of the light guide is arranged within a housing 6 and is divided into a plurality of leads or branches 4 and 8. One branch or lead is associated with a light source 5. The other lead is associated or connected to a photosensitive receiver 7.

Arranged in the sewing machine bed (not shown) is a work supporting throat plate 9. The top surface araa of the throat plate opposite the lowermost end of the light guide is polished to define a reflecting surface. The throat plate 9 is formed with slots 11 through which the feed dog of the work feeding mechanism means are adapted to operate. In the usual manner, the presser foot sole 3 is urged downwardly against the throat plate to cooperate with the feed dog in incremently advancing a workpiece through the sewing area. Both the presser foot sole and the throat plate having needle receiving apertures 12 and 13, respectively, extending vertically therethrough and which permit endwise reciprocation of the needle means.

Figure 2:
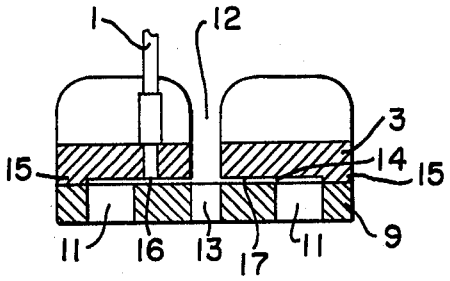
FIG. 2 is an enlarged side sectional view of a portion of the apparatus shown in FIG. 1.
Figure 3:
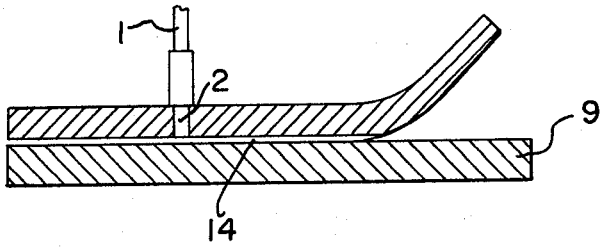
FIG. 3 is a sectional elevational view of the apparatus shown in FIG. 1.

The bottom of the presser foot sole 3 is formed with a pair of side edges 15 which are seperated by a centrally disposed longitudinal or elongated straight groove or recessed channel 14. In the preferred embodiment, the upper wall or face of the channel is planar or flat. With the presser foot sole so designed, the flat upper wall 17 of the channel 14 may be raised from the surface of the throat plate 9. That is, only the side edges 15 of the presser foot sole press against the throat plate 9. The side edges serving to firmly clamp the workpiece beneath the presser foot sole means. As best seen in FIG. 2, the width of the channel or the distance between the side edges 15 is substantially equal to the collective width of the feed dog slots; that is, the distance between the outermost edges of the feed dog slots 11.

The end face or flat surface 16 of the end 2 of the light guide secured in the presser foot sole is arranged in a flush relation with the upper wall or surface 17 of the channel 14 such that it is removed from the top surface of the throat plate 9. Although removed from the throat plate, the distance or space between the end 17 of the light guide and the reflecting surface remains such that the reflected light is adequate to sense the passage of the article therebetween. The channel 14 is relatively narrow, preferably in the range of 0.4 mm, in that area in which the end of the light guide is so disposed.

By this construction, when the article or workpiece is advanced, a workpiece portion may be pressed into the groove 14 and will pass directly beneath the end face 16 of the fiber optic cable. Such workpiece movement effectively and constantly cleanses or wipes any foreign bodies, i.e. dust and threads, from the face of the optic cable. Likewise, a soiling of the reflective surface of the throat plate is eliminated. Due to the groove 14, the normal scratching or wearing effect on the end face 16 of the fiber optic cable is minimized. The provision of the relatively shallow elongated channel also provides a buffer against the vibratory actions of the feed dog means.

In operation, the light from the incandescent bulb 5 is transmitted, without dispersion, through the fiber optics of the branch 4 through the cable 1 and is projected from the cable end 16 as an illuminated spot in the normal path of travel of the workpiece past the stitch forming instrumentalities of the machine. The light is reflected back from the top or reflecting surface of the throat plate 9 and is delivered by the fiber optic means to the optic fibers in branch 8 and is, ultimately, transmitted to the photosensitive cell 7. At the instant the leading edge of the workpiece interrupts the light path defined by the space between the fiber optic light source and the reflecting surface, the photosensitive means 7 changes state. As a result, a pulse may be provided thereby. Said pulse may be used to timely energize any one or plurality of mechanisms, i.e., a thread cutter means or tape cutting apparatus etc. Upon continued operation of the machine, the advancing work blocks the sensor means light path. Therefore, while the work is progressively moved through the sewing area, no pulse may be produced by the photosensitive means 7. The instant the trailing edge of the workpiece passes beyond the sensor means light path, the photosensitive means may again change state in the response to the receipt of light conducted by the optic fibers from the reflective suface to the photosensitive means 3. Again, the second pulse may be used for any one of a plurality of purposes.

Thus it is apparent that there has been provided, in accordance with the invention, a Material Sensing Means for Sewing Machines that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described my invention, what I claim is:

1. A device adapted to monitor the passage of a workpiece edge beneath a sewing machine presser foot assembly, said device comprising:

a presser foot sole means forming a part of said presser foot assembly, said presser foot sole means having a longitudinally extending bottom channel with a vertically elevated top surface and two depending side edge portions;

fiber optic means capable of transmitting light and having one end thereof arranged flush with the top surface of said channel and opposite a reflecting surface; and operative means connected to the other end of said fiber optic means, said operative means being responsive to the interruption and restoration of light caused by the ends of a workpiece passing between the end of the fiber optic means and said reflective surface, said operative means being capable of producing a signal indicative of such workpiece passage.

2. A device adapted to monitor the advancement of workpiece edges beneath a sewing machine presser foot assembly, said device comprising:

fiber optic means capable of transmitting light and having one end thereof arranged flush with a recessed portion of a groove provided along a work contacting surface such that said end is directly exposed to the path of workpiece advancement opposite a reflecting surface in a manner preventing said end from becoming defiled; and operative means associated with the other end of said fiber optic means, said operative means being responsive to the interruption and restoration of light caused by the workpiece ends passing between the exposed end of the fiber optic means and said reflective surface.

3. A device for sensing workpiece edge advancement beneath a sewing machine presser foot assembly and over a throat plate having laterally spaced feed dog slots formed therein, said device comprising:

a presser foot sole portion forming part of said presser foot assembly, said sole portion having a centrally disposed relatively shallow elongated straight channel extending substantially the length of said sole portion;

a fiber optic cable capable of transmitting light and having one end thereof disposed in the direction of workpiece advancement and arranged in a flush relation with an upper most surface of said channel and opposite a reflecting surface; and operative means associated with the opposite end of said optic cable, said operative means being responsive to the interruption and restoration of light caused by the advancing workpiece ends passing between the end of the fiber optic cable and said reflective surface.

4. The invention according to claim 3 wherein said channel spans the collective width of the feed dog slots.

* * * * *